US005474356A

United States Patent [19]

Johnson

[11] Patent Number: 5,474,356

[45] Date of Patent: Dec. 12, 1995

[54] BOOK READING CHAIRS

[76] Inventor: Patrick A. Johnson, 10915 Ky. 657, Lewisport, Ky. 42351

[21] Appl. No.: 232,632

[22] Filed: Apr. 25, 1994

[51] Int. Cl.[6] ..... A47B 19/00

[52] U.S. Cl. ..... 297/156; 297/163; 297/174; 297/411.41

[58] Field of Search ..... 297/156, 163, 297/174, 411.2, 411.41

[56] References Cited

U.S. PATENT DOCUMENTS

| | | | |
|---|---|---|---|
| 533,046 | 1/1895 | Butler | 297/163 X |
| 828,079 | 8/1906 | Williamson | 297/163 X |
| 1,895,338 | 1/1933 | Neumann | 297/163 X |
| 2,364,050 | 12/1944 | Benson | 297/411.2 X |

FOREIGN PATENT DOCUMENTS

| | | | |
|---|---|---|---|
| 103940 | 2/1917 | United Kingdom | 297/163 |

*Primary Examiner*—Peter R. Brown

[57] ABSTRACT

A book reading chair comprising a seat formed in a generally planar rectangular configuration with an upper surface, a lower surface, a front edge and a rear edge. The plane of the seat is positioned horizontally in the operative orientation. Two rear legs are vertically positioned and include coupling means at their uppermost extent for attachment to the seat near its rear edge. Two front legs are vertically positioned and include coupling devices for attachment to the seat. The front legs are positioned closer together than the rear legs and are affixed to the central portion of the seat near its front edge. An extension piece is formed as a generally planar member with a front surface and a rear surface. The extension piece is affixed to the seat and extends vertically upward a distance between about fifty percent and one hundred and fifty percent of the length of the legs. An arm rest is formed in a planar configuration and is positioned horizontally upon the uppermost extent of the extension piece. A book stand is formed in a generally planar rectangular configuration. The stand is adapted to be positioned at a vertical angle in the operative orientation. The lower extent of the stand includes a coupling device for attachment to the arm rest.

1 Claim, 4 Drawing Sheets

BOOK READING CHAIRS

BACKGROUND OF THE INVENTION

1. Field of the Invention

The present invention relates to book reading chairs and more particularly pertains to sitting in chairs specifically designed for comfort while reading vertically positioned literary materials.

2. Description of the Prior Art

The use of chairs and book stands is known in the prior art. More specifically, chairs and book stands heretofore devised and utilized for the purpose of supporting reading materials at a desired angle are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,664,629 to D. L. Reed an adjustable stand.

U.S. Pat. No. 3,476,348 to G. H. Rustad discloses a book rest.

In this respect, the book reading chair according to the present invention substantially departs from the conventional concepts and designs of the prior art, and in doing so provides an apparatus primarily developed for the purpose of sitting in chairs specifically designed for comfort while reading vertically positioned literary materials.

Therefore, it can be appreciated that there exists a continuing need for new and improved book reading chairs which can be used for sitting in chairs specifically designed for comfort while reading vertically positioned literary materials. In this regard, the present invention substantially fulfills this need.

SUMMARY OF THE INVENTION

In view of the foregoing disadvantages inherent in the known types of chairs and book stands now present in the prior art, the present invention provides an improved book reading chair. As such, the general purpose of the present invention, which will be described subsequently in greater detail, is to provide a new and improved book reading chair and method which has all the advantages of the prior art and none of the disadvantages.

To attain this, the present invention essentially comprises a new and improved book reading chair comprising a seat formed in a generally planar rectangular configuration with parallel front and rear edges, and parallel side edges. The seat includes four rounded corners, with the plane of the seat being positioned horizontally in the operative orientation. The seat also includes an upper surface and a lower surface. Two rear legs are each formed as a long planar rectangular block. The legs are positioned vertically and have an upper region and a lower region, with both regions terminating in flat ends. The legs also have a wide front face, a wide back face, and two narrow side faces. The rear legs are positioned below the corners of the rear edge of the seat with the wide back faces parallel to the rear edge of the seat. The rear legs include coupling means at their uppermost extent to allow attachment to the lower surface of the seat. Two front legs are each formed as a long planar rectangular block. The legs are positioned vertically and have an upper region and a lower region, with both regions terminating in flat ends. The legs also have a wide front face, a wide back face and two narrow side faces. The front legs are positioned closer together than the rear legs. The wide back surface of the legs includes coupling means and is affixed flush against the front edge of the seat near its middle portion. Three cross supports are formed as planar rectangular blocks. Each support has a wide front face, a wide back face and two narrow side faces. Each support has flat outer ends which include coupling means and is positioned horizontally with its narrow side faces parallel to the plane of the seat. A first cross support is positioned between the rear legs slightly above the center point of the legs. The first support has its flat ends affixed to the narrow side faces of the rear legs. A second and third support is positioned between the front and rear legs. The second and third supports have one of their flat ends attached to the wide front faces of the first cross support at its attachment point to the rear legs. The other end of the second and third cross supports are angled inwardly and coupled with the wide back faces of the front legs. An extension piece is formed contiguously with the front legs of the apparatus. The extension piece consists of two vertically positioned parallel planar rectangular blocks which extend above the upper surface of the seat about the same distance as the length of the legs. The extension piece includes a middle segment which has a front and rear surface and is positioned at the center point of the extension piece. The middle segment is formed as a planar rectangular block with a vertical height equal to about half the height of the extension piece. The middle segment includes coupling means on two of its ends to permit attachment between the two blocks of the extension piece. The plane of the extension piece is positioned perpendicular to the plane of the seat. The rear surface of the middle segment includes a horizontally disposed groove located a short distance above its center point. An arm rest is formed in a planar configuration with a linear front edge and two parallel linear side edges perpendicularly disposed with respect to the front edge. The front edge of the arm rest is positioned horizontally upon the uppermost extent of the extension piece. The front edge also includes a centrally positioned screw hole. The rear portion of the arm rest has two convex curved end segments formed contiguously with the linear side edges, with a concave depression positioned therebetween. A book stand has a front component and a back component. The front component is formed in a generally planar rectangular configuration with parallel long sides, parallel short sides, a small thickness, and a front and rear surface. The stand has one long edge representing the upper extent of the stand and one long edge representing the lower extent of the stand. The lower extent of the stand has an angled end with a circular aperture extending through its rear surface. A bolt is adapted to couple the stand to the front edge of the arm rest through the circular aperture. The back component of the stand is formed in a generally planar rectangular configuration with an upper region and a lower region. The upper region has a larger width than the lower region with a gradually decreasing width therebetween. The uppermost extent of the upper region includes coupling means to permit attachment near the upper extent of the rear surface of the front component of the stand. The lowermost extent of the rear component is adapted to permit insertion into the groove in the middle segment. The front component is positioned at an angle of between about thirty and sixty degrees with respect to the plane of the arm rest.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved book reading chairs which have all the advantages of the prior art book stands and none of the disadvantages.

It is another object of the present invention to provide new and improved book reading chairs which may be easily and efficiently manufactured and marketed.

It is further object of the present invention to provide new and improved book reading chairs which are of durable and reliable constructions.

An even further object of the present invention is to provide new and improved book reading chairs which are susceptible of a low cost of manufacture with regard to both materials and labor, and which accordingly are then susceptible of low prices of sale to the consuming public, thereby making such book reading chairs economically available to the buying public.

Still yet another object of the present invention is to provide new and improved book reading chairs which provide in the apparatuses and methods of the prior art some of the advantages thereof, while simultaneously overcoming some of the disadvantages normally associated therewith.

Still another object of the present invention is to sit in chairs specifically designed for comfort while reading vertically positioned literary materials.

Lastly, it is an object of the present invention to provide a new and improved book reading chair comprising a seat formed in a generally planar rectangular configuration with an upper surface, a lower surface, a front edge and a rear edge. The plane of the seat is positioned horizontally in the operative orientation. Two rear legs are vertically positioned and include coupling means at their uppermost extent for attachment to the seat near its rear edge. Two front legs are vertically positioned and include coupling devices for attachment to the seat. The front legs are positioned closer together than the rear legs and are affixed to the central portion of the seat near its front edge. An extension piece is formed as a generally planar member with a front surface and a rear surface. The extension piece is affixed to the seat and extends vertically upward a distance between about fifty percent and one hundred and fifty percent of the length of the legs. An arm rest is formed in a planar configuration and is positioned horizontally upon the uppermost extent of the extension piece. A book stand is formed in a generally planar rectangular configuration. The stand is adapted to be positioned at a vertical angle in the operative orientation. The lower extent of the stand includes a coupling device for attachment to the arm rest.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
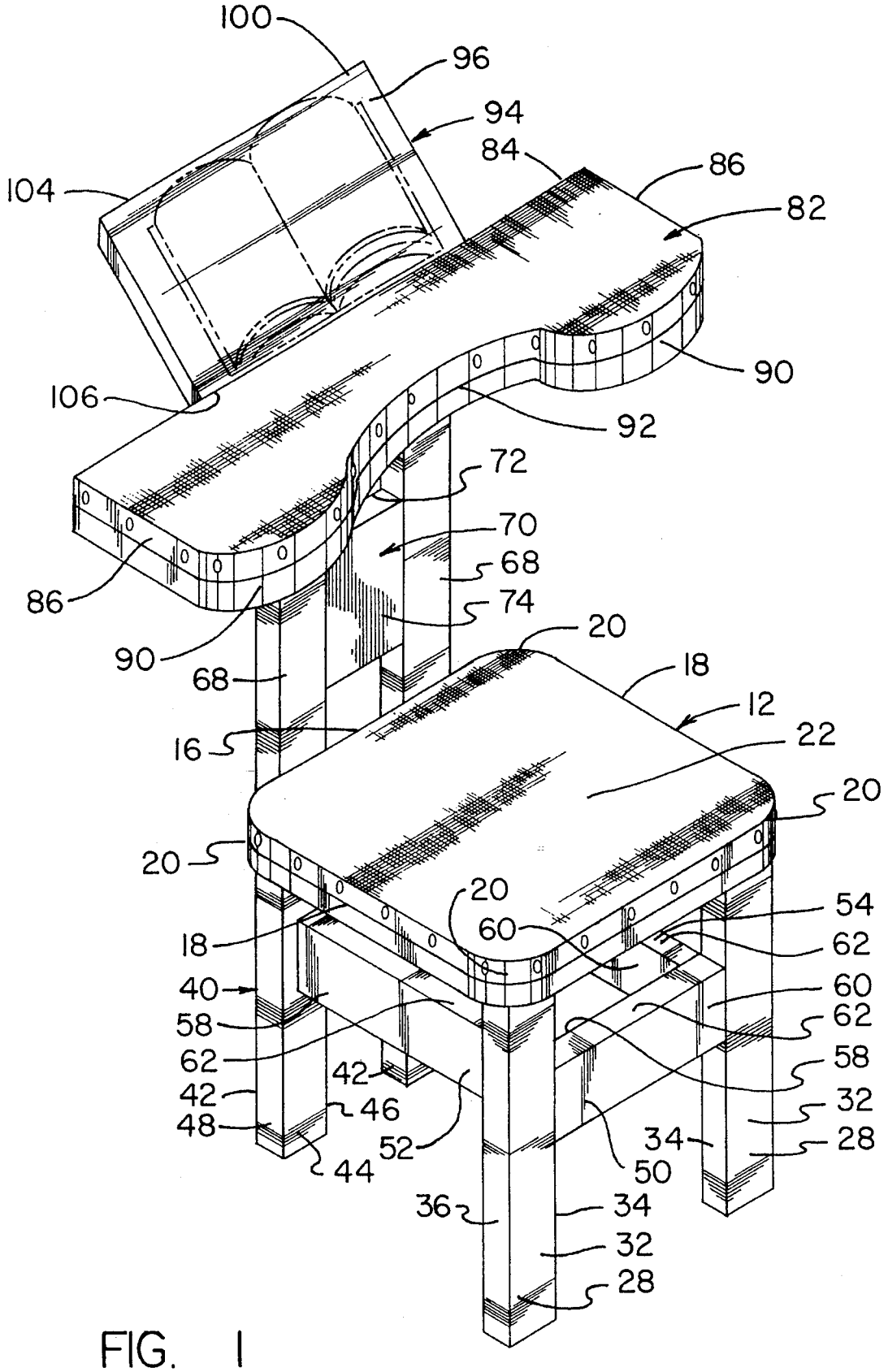
FIG. 1 is a perspective view of the preferred embodiment of the book reading chair constructed in accordance with the principles of the present invention.
Figure 2:
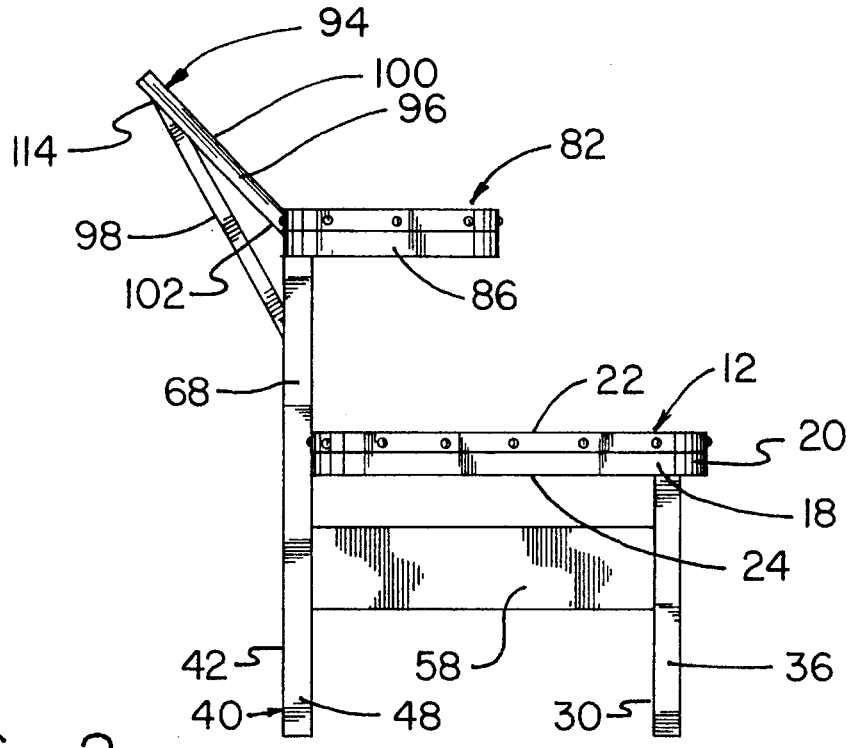
FIG. 2 is a side elevational view of the book reading chair shown FIG. 1.
Figure 3:
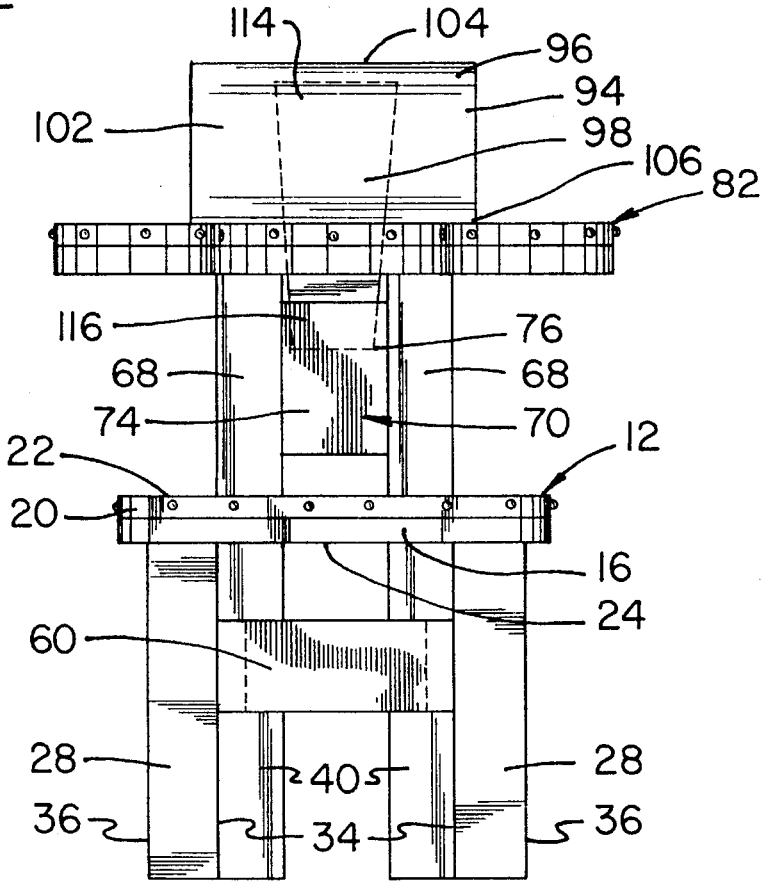
FIG. 3 is a rear elevational view of the book reading chair shown in FIG. 1.
Figure 4:
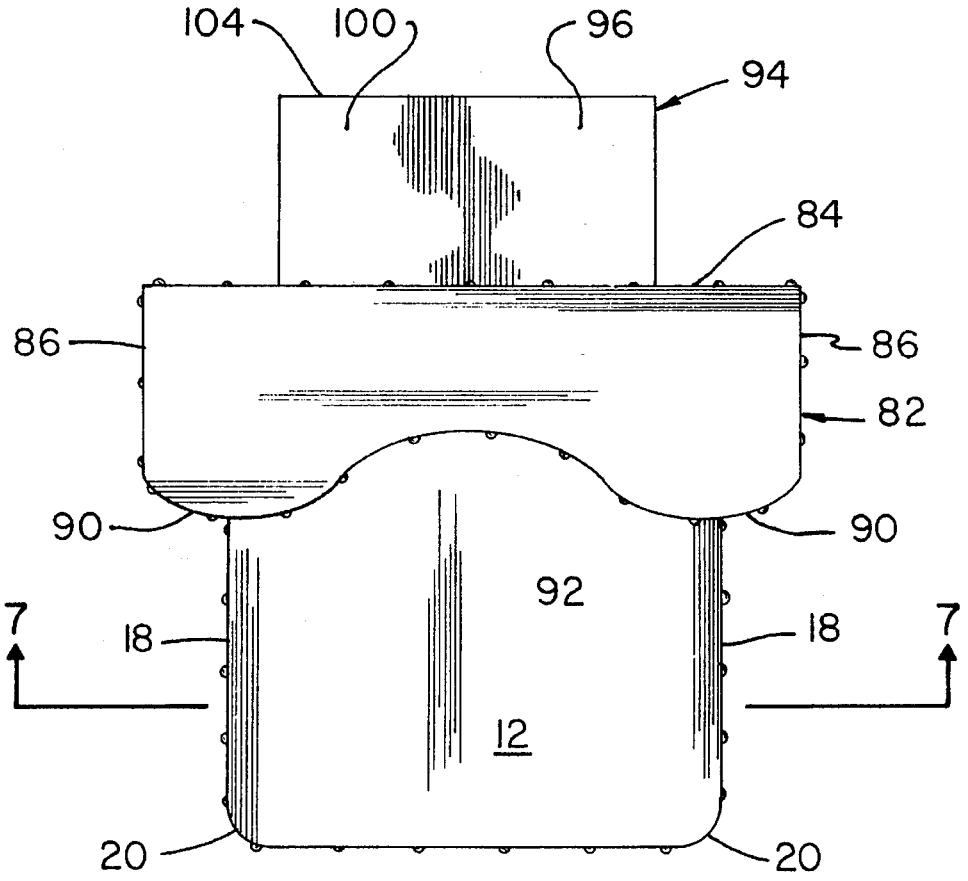
FIG. 4 is a top plan view of the book reading chair shown in FIG. 1.
Figure 5:
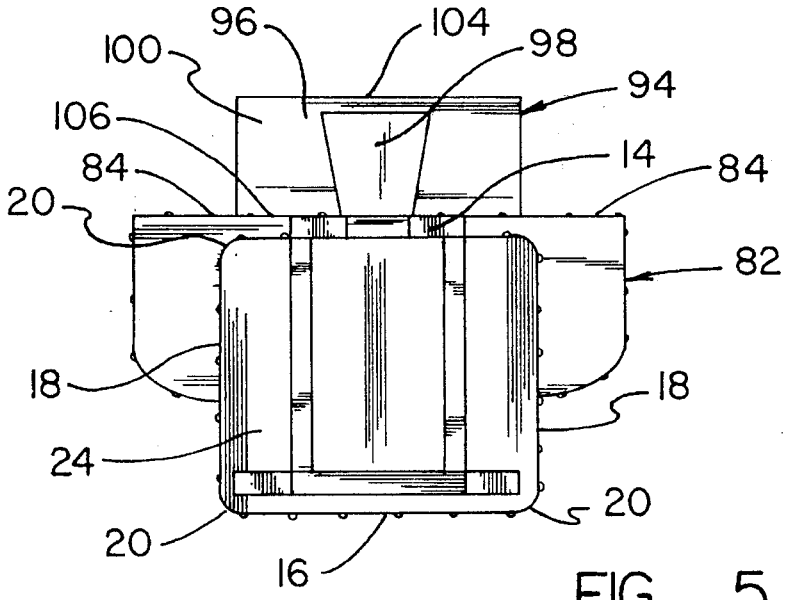
FIG. 5 is a bottom plan view of the book reading chair shown in FIG. 1.
Figure 6:
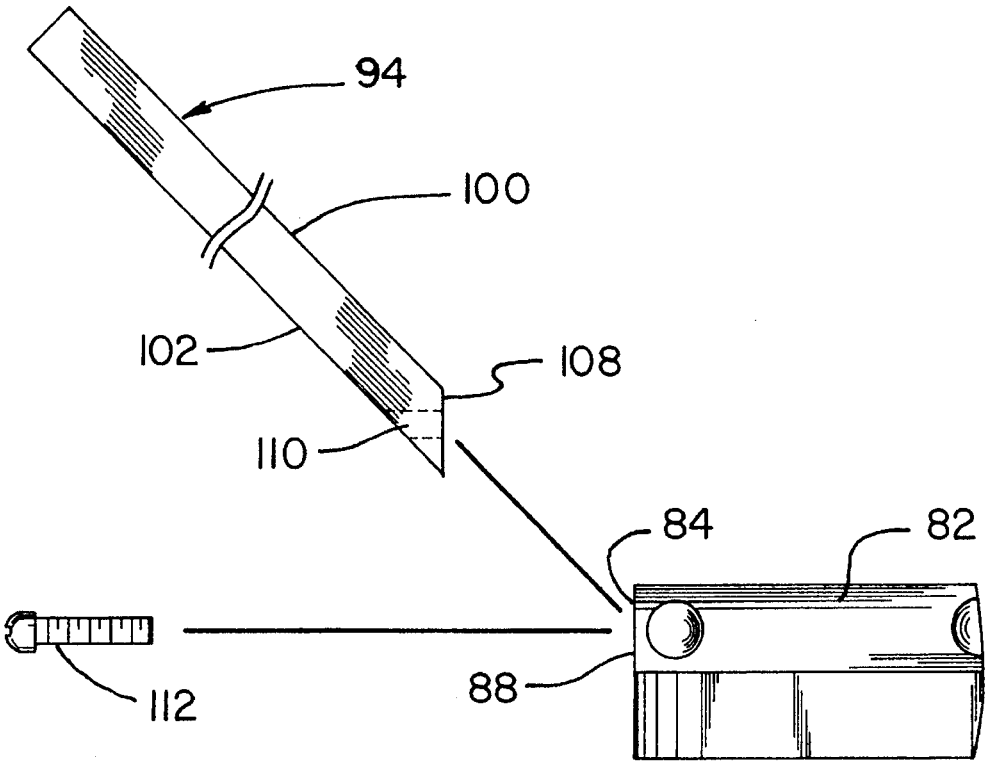
FIG. 6 is a broken away side perspective view of the arm rest and book stand components of the apparatus.
Figure 7:
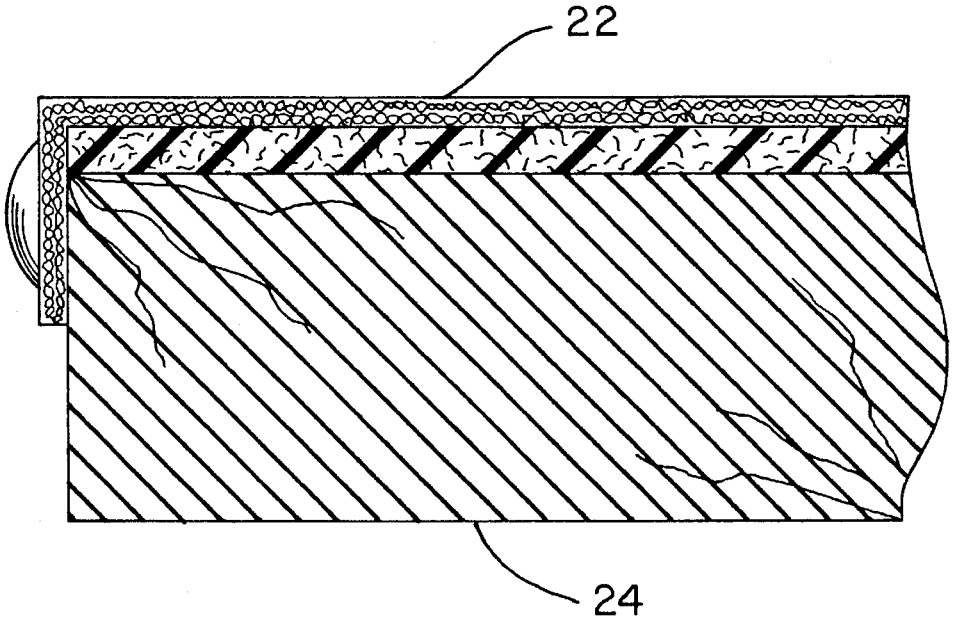
FIG. 7 is a broken away cross sectional view of the seat component of the apparatus taken along line 7—7 of FIG. 4.

With reference now to the drawings, and in particular to FIG. 1 thereof, the preferred embodiment of the new and improved book reading chairs embodying the principles and concepts of the present invention and generally designated by the reference numeral 10 will be described.

Specifically, it will be noted in FIGS. 1 through 7, that there is provided a new and improved book reading chairs. The book reading chair 10, in its broadest context, comprises a seat 12, two rear legs 28, two front legs 40, three cross supports 50, 52, 54, an extension piece 66, an arm rest 82 and a book stand 94.

More specifically, the seat 12 is formed in a generally planar rectangular configuration with parallel front 14 and rear 16 edges, and parallel side edges 18. Like most chair seats, this seat includes four rounded corners 20, with the plane of the seat being positioned horizontally in the operative orientation. The seat also includes an upper surface 22 and a lower surface 24. The seat may also be manufactured with a fabric covering to provide a more comfortable seating area for the user. Note FIG. 1 in particular.

Two rear legs 28 are each formed as a long planar rectangular block. The legs 28 are positioned vertically and have an upper region and a lower region, with both regions terminating in flat ends. The legs also have a wide front face 30, a wide back face 32, and two narrow side faces 34, 36. The rear legs are positioned below the corners of the rear edge of the seat with the wide back faces parallel to the rear edge 16 of the seat. The rear legs 28 include coupling means at their uppermost extent to allow attachment to the lower surface 24 of the seat. The legs are comprised of sturdy materials to enable them to support individuals of varying weights. Note FIGS. 1 and 3.

Two front legs 40 are each formed as a long planar rectangular block. The legs 40 are positioned vertically and have an upper region and a lower region, with both regions terminating in flat ends. The legs 40 also have a wide front face 42, a wide back face 44 and two narrow side faces 46, 48. The front legs 40 are positioned closer together than the rear legs 28. The close spacing of the front legs permits a user to comfortably straddle the front legs when utilizing the apparatus. The wide back surface of the legs includes coupling means and is affixed flush against the front edge 14 of the seat near its middle portion. The legs are comprised of sturdy materials to enable them to support individuals of varying weights. Note FIGS. 1 and 3.

Three cross supports 50, 52, 54 are formed as planar rectangular blocks. Each support has a wide front face 58, a wide back face 60 and two narrow side faces 62. Each support 50, 52, 54 has flat outer ends which include coupling means and is positioned horizontally with its narrow side faces 62 parallel to the plane of the seat 12. A first cross support 50 is positioned between the rear legs 28 slightly above the center point of the legs 28. The support adds strength and stability to the rear legs. The first support has its flat ends affixed to the narrow side faces 34 of the rear legs 28. Note FIGS. 1, 2 and 3.

A second 52 and third 54 support is positioned between the front 40 and rear legs 28. The second 52 and third 54 supports have one of their flat ends attached to the wide front faces 58 of the first cross support 50 at its attachment point to the rear legs. The front faces of the supports are positioned to face outward. The front faces are attached even with the end edges of the first cross support. The other end of the second 52 and third 54 cross supports are angled inwardly and coupled with the wide back faces 44 of the front legs 40. The supports adds strength and stability to the seat. Note FIGS. 1, 2 and 3.

An extension piece 66 is formed contiguously with the front legs 40 of the apparatus. The extension piece 66 consists of two vertically positioned parallel planar rectangular blocks 68 which extend above the upper surface 22 of the seat about the same distance as the length of the legs. The uppermost extent of the extension piece rises to approximately the upper extent of the stomach of most users. Note FIGS. 1 and 3.

The extension piece 66 includes a middle segment 70 which has a front 72 and rear 74 surface and is positioned at the center point of the extension piece 66. The middle segment adds strength and stability to the extension piece. The middle segment 70 is formed as a planar rectangular block with a vertical height equal to about half the height of the extension piece 66. The middle segment 70 includes coupling means on two of its ends to permit attachment between the two blocks 68 of the extension piece. The plane of the extension piece 66 is positioned perpendicular to the plane of the seat. The rear surface 74 of the middle segment includes a horizontally disposed groove 76 located a short distance above its center point. Note FIGS. 1 and 3.

An arm rest 82 is formed in a planar configuration with a linear front edge 84 and two parallel linear side edges 86 perpendicularly disposed with respect to the front edge 84. The front edge 84 of the arm rest 82 is positioned horizontally upon the uppermost extent of the extension piece 66. The front edge 84 also includes a centrally positioned screw hole 88. The rear portion of the arm rest has two convex curved end segments 90 formed contiguously with the linear side edges 86, with a concave depression 92 positioned therebetween. The arm rest is positioned at approximately the upper extent of the stomach of most users. This height permits a user to comfortably rest his arms on the arm rest when reading. The concave groove in the central portion of the arm rest provides a clearance area for the user. The seat may also be manufactured with a fabric covering to provide a more comfortable seating area for the user. Note FIGS. 1, 4 and 6.

A book stand 94 has a front component 96 and a back component 98. The front component 96 is formed in a generally planar rectangular configuration with parallel long sides, parallel short sides, a small thickness, and a front 100 and rear 102 surface. Users place the desired literary materials on the front surface of the front component when using the chair. The stand 94 has one long edge representing the upper extent 104 of the stand and one long edge representing the lower extent of the stand 106. The lower extent 106 of the stand has an angled end 108 with a circular aperture 110 extending through its rear surface. A bolt 112 is adapted to couple the stand to the front edge 84 of the arm rest through the circular aperture 110. The angle of the stand, between about thirty and sixty degrees with respect to the plane of the arm rest, permits a user to comfortably read literary materials when sitting in the chair. Note FIGS. 1, 2, 5 and 6.

The back component 98 of the stand is formed in a generally planar rectangular configuration with an upper region 114 and a lower region 116. The upper region 114 has a larger width than the lower region 116 with a gradually decreasing width therebetween. The uppermost extent of the upper region 114 includes coupling means to permit attachment near the uppermost extent 104 of the rear surface 102 of the front component of the stand. The lowermost extent of the rear component 98 is adapted to permit insertion into the groove 76 in the middle segment 70. The front component 96 is positioned at an angle of between about thirty and sixty degrees with respect to the plane of the arm rest 82. When coupled inside the groove in the middle segment, the back component serves as a sturdy support for the front component and the literary materials placed thereupon. Note FIGS. 1, 2, 5 and 6.

The "Book Reading Chair," as the name suggests, is expressly designed to be used when reading a book or magazine. The book reading chair has no back panel, and the rear legs, which include a stabilizing cross support, are located along the rear edge of the chair just inside each of the corners.

The front legs are much closer together than those on a standard chair. An extension piece is positioned on top of the front legs and extends upward well beyond the seating panel itself. They are supported with a cross support just above the seating area, and additional angled cross supports extend from the rear legs to the front legs. An arm rest mounted on top of the extension piece includes a concave recess which serves as a clearance for the user's chest.

Hence, it can be seen that one may sit with their legs straddling the front legs of the chair while the book or magazine is independently supported by the book stand. One may lean against the arm rest with their chest or place their forearms and elbows across the top of the rest. In either position, the back will be erect, and the book will be clearly visible. The book reading chair is very comfortable, and one may read for hours without experiencing fatigue. It will be ideal for use in home studies and libraries, or simply placed in the den or other reading room within the home.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved book reading chair comprising, in combination:

a seat formed in a generally planar rectangular configuration with parallel front and rear edges and parallel side edges, the seat including four rounded corners, with the plane of the seat being positioned horizontally in the operative orientation, the seat also having an upper surface and a lower surface;

two rear legs, each being formed as a long planar rectangular block, the legs being positioned vertically and having an upper region and a lower region with both regions terminating in flat ends, the legs also having a wide front face and wide back face with two narrow side faces, the rear legs being positioned below the corners of the rear edge of the seat with the wide back face parallel to the rear edge of the seat, the rear legs including coupling means at their uppermost extent to allow attachment to the lower surface of the seat;

two front legs, each being formed as a long planar rectangular block, the legs being positioned vertically and having an upper region and a lower region with both regions terminating in flat ends, the legs also having a wide front face and wide back face with two narrow side faces, the front legs being positioned closer together than the rear legs, the wide back surface of the legs including coupling means and affixed flush against the front edge of the seat near its middle portion;

three cross supports formed as planar rectangular blocks, each support having a wide front face and wide back face and two narrow side faces, each support having flat outer ends including coupling means and positioned horizontally with its narrow side faces parallel to the plane of the seat, a first cross support being positioned between the rear legs slightly above the center point of the legs, the first support having its flat ends affixed to the narrow side faces of the rear legs, a second and third support being positioned between the front and rear legs, the second and third supports having one of their flat ends attached to the wide front faces of the first cross support at its attachment point to the rear legs, with the other end of the second and third cross supports being angled inwardly and coupled with the wide back faces of the front legs;

an extension piece formed contiguously with the front legs of the apparatus, the extension piece consisting of two vertically positioned parallel planar rectangular blocks extending above the upper surface of the seat about the same distance as the length of the legs, the extension piece including a middle segment having a front and rear surface and positioned at the center point of the extension piece, the middle segment being formed as a planar rectangular block with a vertical height equal to about half the height of the extension piece, the middle segment including coupling means on two of its ends to permit attachment between the two blocks of the extension piece, the plane of the extension piece being positioned perpendicular to the plane of the seat, with the rear surface of the middle segment including a horizontally disposed groove located a short distance above its center point;

an arm rest formed in a planar configuration with a linear front edge and two parallel linear side edges perpendicularly disposed with respect to the front edge, the front edge of the arm rest being positioned horizontally upon the uppermost extent of the extension piece, the front edge also including a centrally positioned screw hole, the rear portion of the arm rest having two convex curved end segments formed contiguously with the linear side edges with a concave depression positioned therebetween; and a book stand having a front component and a back component, the front component formed in a generally planar rectangular configuration with parallel long sides, parallel short sides, a small thickness, and a front and rear surface, the stand having one long edge representing the upper extent of the stand and one long edge representing the lower extent of the stand, the lower extent of the stand having an angled end with a circular aperture extending through its rear surface, a bolt being adapted to couple the stand to the front edge of the arm rest through the circular aperture, the back component of the stand being formed in a generally planar rectangular configuration with an upper region and a lower region, the upper region having a larger width than the lower region with a gradually decreasing width therebetween, the uppermost extent of the upper region including coupling means to permit attachment near the upper extent of the rear surface of the front component of the stand, the lowermost extent of the rear component being adapted to permit insertion into the groove in the middle segment, the front component being positioned at an angle of between thirty and sixty degrees with respect to the plane of the arm rest.

* * * * *